US008887441B2

(12) United States Patent
Lundh

(10) Patent No.: US 8,887,441 B2
(45) Date of Patent: Nov. 18, 2014

(54) CHILD SAFETY GATE

(76) Inventor: Joran Lundh, Kowloon (CN)

( * ) Notice: Subject to any disclaimer, the term of this patent is extended or adjusted under 35 U.S.C. 154(b) by 197 days.

(21) Appl. No.: 12/999,566

(22) PCT Filed: Jul. 15, 2009

(86) PCT No.: PCT/EP2009/059022

§ 371 (c)(1),
(2), (4) Date: Dec. 16, 2010

(87) PCT Pub. No.: WO2010/007078

PCT Pub. Date: Jan. 21, 2010

(65) Prior Publication Data

US 2011/0088323 A1 Apr. 21, 2011

Related U.S. Application Data

(60) Provisional application No. 61/080,856, filed on Jul. 15, 2008.

(30) Foreign Application Priority Data

Jul. 15, 2008 (SE) ..... 0801694

(51) Int. Cl.
*E06B 3/68* (2006.01)

(Continued)

(52) U.S. Cl.
CPC . *E05B 43/00* (2013.01); *E06B 9/04* (2013.01); *E05B 65/0014* (2013.01); *E06B 2009/002* (2013.01)
USPC ..... 49/55; 49/56; 160/296

(58) Field of Classification Search
CPC .. E01F 13/028; E01F 13/04; E06B 2009/002; E06B 9/78; E06B 9/42; E09B 9/80
USPC ..... 49/50, 55; 160/23.1, 24, 296, 301; 188/290, 306, 307; 74/553, 556
See application file for complete search history.

(56) References Cited

U.S. PATENT DOCUMENTS 1,235,451 A * 7/1917 Evans ..... 160/300
3,431,966 A 3/1969 Injeski (Continued)

FOREIGN PATENT DOCUMENTS

GB 1465050 2/1977
JP 06-330680 11/1994

(Continued)

OTHER PUBLICATIONS

International Search Report from corresponding International Application No. PCT/EP2009/059022, mailed Nov. 10, 2009.

(Continued)

*Primary Examiner* — Katherine Mitchell
*Assistant Examiner* — Shiref Mekhaeil
(74) *Attorney, Agent, or Firm* — Polster, Lieder, Woodruff & Lucchesi, L.C.

(57) ABSTRACT

A child safety gate having a locking device and a flexible retractable barrier sheet is disclosed. The locking device comprises a locking means having at least a locked position and an unlocked position. The locking means is configured to in its locked position prevent further extraction of the flexible retractable barrier sheet, and the locking means is configured to in its unlocked position allow at least extraction of the flexible retractable barrier sheet. Further, the locking device comprises a timer means configured to upon activation let a delay time elapse and then bring the locking means into its locked position.

An advantage of the locking device is that it provides safe operation of a child safety gate by automatically locking the locking device after a delay time has elapsed.

21 Claims, 7 Drawing Sheets

(51) Int. Cl.

| | |
|---|---|
| ***E06B 7/00*** | (2006.01) |
| ***E06B 9/01*** | (2006.01) |
| ***E06B 9/04*** | (2006.01) |
| ***E05B 65/00*** | (2006.01) |
| ***E05B 43/00*** | (2006.01) |
| *E06B 9/00* | (2006.01) |

(56) References Cited

U.S. PATENT DOCUMENTS

| | | | | | |
|---|---|---|---|---|---|
| 3,638,682 | A | * | 2/1972 | Heyer et al. | 137/624.12 |
| 3,647,224 | A | * | 3/1972 | Klein | 369/246 |
| 3,823,586 | A | * | 7/1974 | Melancon | 70/268 |
| 3,933,337 | A | * | 1/1976 | Morris et al. | 251/54 |
| 3,972,533 | A | * | 8/1976 | Huff | 369/230 |
| 4,191,096 | A | * | 3/1980 | Benjamin | 92/143 |
| 4,269,050 | A | * | 5/1981 | Bechtiger et al. | 70/272 |
| 4,359,883 | A | * | 11/1982 | Bechtiger et al. | 70/269 |
| 4,492,263 | A | | 1/1985 | Gebhard | |
| 4,523,745 | A | | 6/1985 | Killman et al. | |
| 4,723,587 | A | | 2/1988 | Scruggs, Jr. | |
| 4,791,251 | A | * | 12/1988 | Carter et al. | 200/33 R |
| 4,989,713 | A | * | 2/1991 | Janson | 192/208 |
| 5,690,317 | A | * | 11/1997 | Sandsborg | 256/1 |
| 5,697,122 | A | * | 12/1997 | Okabe et al. | 16/82 |
| 6,536,502 | B2 | | 3/2003 | Britto et al. | |
| 6,711,857 | B1 | * | 3/2004 | Wagnitz et al. | 49/394 |
| 6,907,914 | B1 | * | 6/2005 | Lundh | 160/301 |
| 7,178,792 | B2 | * | 2/2007 | Monahan et al. | 256/73 |
| 7,204,353 | B2 | * | 4/2007 | Kanno et al. | 188/290 |
| 7,219,709 | B1 | * | 5/2007 | Williams | 160/24 |
| 7,438,112 | B2 | * | 10/2008 | Cheng | 160/24 |
| 2006/0070835 | A1 | * | 4/2006 | Kanno et al. | 188/290 |
| 2010/0038196 | A1 | * | 2/2010 | Krammer | 188/290 |

FOREIGN PATENT DOCUMENTS

| | | | |
|---|---|---|---|
| JP | 06-083894 | | 12/1994 |
| JP | 2001-288971 | | 10/2001 |
| JP | 2004-346707 | | 12/2004 |
| JP | 2007-231608 | | 9/2007 |
| WO | 9400664 | A1 | 1/1994 |
| WO | 2005040530 | A1 | 5/2005 |

OTHER PUBLICATIONS

Office Action for corresponding Japanese Application No. 2013-155895 mailed Jul. 15, 2014.

* cited by examiner

CHILD SAFETY GATE

CROSS-REFERENCE TO RELATED APPLICATIONS

The present application is the US national stage under 35 U.S.C. §371 of International Application No. PCT/EP2009/059022 which was filed on Jul. 15, 2009 and which claims the priority of Swedish Application No. 0801694-1 and U.S. Provisional Application No. 61/080,856 both of which were filed Jul. 15, 2008.

TECHNICAL FIELD

The present invention generally relates to a child safety gate, and in particular to a locking device for a child safety gate comprising a flexible retractable barrier sheet.

BACKGROUND

There are several types of child safety gates known in the art: the lazy-tong expansible gate, as illustrated in U.S. Pat. No. 4,523,745A1 and U.S. Pat. No. 4,723,587A1; and gates which are held into place through a wedging, jamming, or pressure action, as illustrated in U.S. Pat. No. 4,492,263A1 and U.S. Pat. No. 3,431,966A1.

Child safety gates are mainly used to prevent small children from entering dangerous places in a home, i.e. staircases, kitchens etc. Thus the safety gates ought to be easily opened by a grown-up person but not by a child.

Apart from the above mentioned gate types, there is known a type of child safety gate which is designed with a gate barrier member made of flexible sheet material which is rolled up on a roll when not in use, and which can be pulled out to close an opening. Such a gate type is illustrated, for example, in WO9400664A1. The roll is preferably mounted vertically along one side of the opening to be closed by the gate. On the other side of the opening to be closed there is mounted a holding means, such as hooks or other locking means, for locking the free end of the sheet material when the sheet has been pulled out to cover the gate opening.

This type of safety gate is provided with rollback means to provide a momentum for winding up the sheet on the roll when not in use. Since openings to be covered by a child safety gate may be of varying sizes (widths), the sheet material is often longer than the width of the widest of common openings. Hence, when the sheet is extracted to fully cover an opening, it may be pulled out even more, since the width of the opening is less than the length of the sheet. The extra length of the sheet material brings the disadvantage that if someone leans against the sheet, he/she might force the sheet to be further pulled out and hence, he/she may gain access to the other side of the opening. This is undesirable and dangerous for a child or a pet.

Current child safety gates provide some sort of means for keeping the sheet material from being extracted further than a desired length.

WO9400664A1 discloses a child safety gate for blocking a passage, particularly for children and pets. The gate can be suspended at one of its side edges and is lockable at its other side edge by means of a child-proof locking device. The gate consists, between its side edges, of a roll-type curtain, which can be rolled around one of the side edges.

U.S. Pat. No. 6,536,502B2 discloses an adjustable width child safety device comprising an adjustable extension limiter, which makes it possible to set a maximum extension length for the sheet material. A disadvantage of the device is that you can only choose the maximum extension length from a multiplicity of selectable positions, which makes it difficult to perfectly adapt the maximum length of the sheet material to the width of an opening. Further, it is cumbersome to use the safety gate in an opening with another width, since the maximum extension has to be manually adjusted.

U.S. Pat. No. 7,178,792B2 discloses an adjustable width child safety device comprising an electrically operable extension lock adapted to prevent extension of the screen from the housing until electrically unlocked. A disadvantage of the safety device is that a person engaging the safety device might forget to activate the lock, thus presenting potential dangers to a child leaning into the gate. Also, the device is dependant on electricity, which could be dangerous if the electricity for some reason does not work and a person activating the lock does not realize that the locking mechanism did not engage properly. If the electricity does not work it may also be difficult to disengage the lock to remove the safety device from the opening, possibly being dangerous in the case of fire.

U.S. Pat. No. 6,907,914B1 discloses a locking device for a baby safety gate. Using the locking device, it is possible to unwind any length of sheet material and then have the locking device prevent further unwinding once a desired length of sheet material has been unwound. The locking device permits one continuous unwinding action, but prevents further unwinding once a rewinding action has begun. A disadvantage of the locking device is that if a person unwinding the sheet material accidentally releases the sheet material so that a rewinding action begins, a person has to unlock the locking device again to make it possible to unwind the sheet material.

U.S. Pat. No. 5,690,317A1 discloses a spring roller-mounted pull-out screen for use as a child safety barrier across a doorway. Further, a control mechanism is provided for preventing the screen from extending when impacted by a child. The roller is locked against rotation in a direction allowing the screen to unwind unless released by a manual push-button. The roller automatically locks after the screen has been extended and slightly released to be slightly rewound onto the roll. The automatic locking mechanism operates by a friction drive, which releases a pawl to spring into engagement with a ratchet wheel when the screen has been pulled out and released. When closing a gate with the above disclosed control mechanism, a person closing the gates often has to coax with the sheet when attaching it in its extended position. Since the above disclosed control mechanism only allows the sheet to be pulled outwards once every time the sheet has been fully wound up, the person coaxing with the sheet often seem himself/herself having accidentally released the sheet slightly before the sheet was securely attached in its extended position. Thus, the control mechanism locks the sheet from further extraction and the person has to unlock the locking device again to make it possible to unwind the sheet material and once again try to securely attach the sheet in its extended position. Another disadvantage with this system is that the locking mechanism creates a disturbing clicking noise when the sheet is rewound onto the roll. This noise is especially disturbing at night-time. Further, a person having disengaged the locking mechanism in order to open the gate might then decide not to open the gate, whereupon the person might forget to reactivate the locking mechanism. This presents a potential danger for children and animals normally stopped by the gate, since the sheet is free to be wound off the roll.

Thus, a locking device for a child safety gate providing:

safe operation, easy adoption for openings of different width, easy opening and closing of the gate, and quiet operation, would be advantageous.

SUMMARY

Accordingly, the present invention seeks to mitigate, alleviate or eliminate one or more of the above-identified deficiencies in the art and disadvantages singly or in any combination and solves at least the above mentioned problems by providing a child safety gate and a method, the child safety gate and method having the features shown in the drawings and described below.

BRIEF DESCRIPTION OF THE DRAWINGS

The invention will be described below in more detail with reference to examples of embodiments thereof shown in the appended drawings.

DETAILED DESCRIPTION OF EMBODIMENTS

Figure 1:
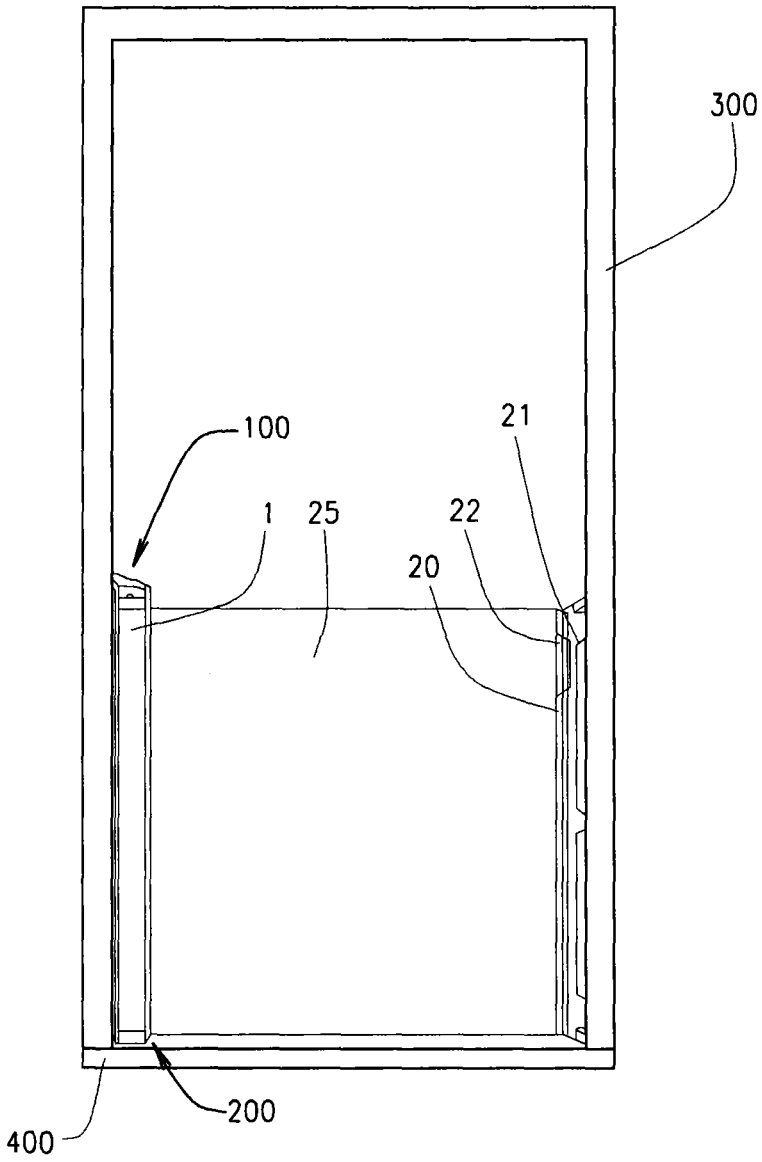
FIG. 1 is a front view of a child safety gate shown in its closed position.

A child safety gate according to an embodiment of the invention, in its closed position mounted in a doorpost 300, just above a floor 400, is shown in FIG. 1. According to this embodiment, the gate comprises:

a flexible sheet 25,
a housing 1,
a locking device 100,
a rollback device 200,
a locking rod 20,
a locking trim 21, and
a handle 22.

With reference to FIGS. 1, 2, 4 and 5, the flexible sheet 25 may be made of a natural or synthetic material, such as cloth or woven fabric, or any material that may be attached to and wound up onto a roll 24. The sheet 25 may be pulled out and wound off the roll 24 to cover an opening. The roll 24 is positioned inside the housing 1 and is at one end connected to the locking device 100 and at the other end connected to the rollback device 200. The rollback device 200 is attached to one end of the housing 1 and is configured to provide a momentum for rotating the roll 24 for rolling back the sheet 25 onto the roll 24 after the sheet 25 has been pulled out. The locking device 100 is attached to the other end of the housing 1, and comprises a timer means 100A and a locking means 100B.

The outer end of the sheet 25 may be attached to a locking rod 20. The locking rod 20 stabilizes the outer end of the sheet 25 and fits with the locking trim 21 so that the locking rod 20 may be hooked onto the trim 21 for preventing the sheet 25 to be rolled up onto the roll 24. The handle 22 is attached to the locking rod 20 and may be used to easily move the rod 20 into interlocking engagement with the locking trim 21. The locking trim 21 is often positioned on the opposite side of an opening relative to the housing 1 so that the sheet 25 may be pulled out and attached between the housing 1 and the locking trim 21 for covering the opening.

The housing 1 and the locking trim 21 may be mounted in a substantially vertical position, although other positions are possible depending on the geometry of the opening to be covered. For example, a child safety gate could be horizontally mounted for covering a hole in a floor or vertically mounted for covering an opening in a vertical wall. The housing 1 and the locking trim 21 are preferably attached by means of screws, but could as well be attached using special fittings, nails, adhesive or strong magnets. The housing 1 is preferably an extruded longitudinal aluminum profile with open ends and a length adapted to the length of the roll 24. However, the housing 1 could also be made of plastic or some other suitable material.

The locking means 100B of the locking device 100 has at least a locked position and an unlocked position. The locking means 100B is configured to prevent further extraction of the flexible sheet 25 attached to the roll 24 when in its locked position. Also, the locking means 100B is configured to allow at least extraction of the flexible retractable barrier sheet 25 when in its unlocked position. Preferably, the locking device 100 always allows retraction of the barrier sheet 25, although the locking device 100 may be configured to only allow extraction of the sheet 25 upon activation of a mechanism, so that children are prevented from playing with the sheet 25 by extracting it from the base unit. The locking means 100B is configured to allow the locking means 100B to be released in order to bring the locking device 100 into its unlocked position.

The timer means 100A is configured to upon activation let a certain time elapse and then bring the locking means 100B into its locked position. The timer means 100A may be a mechanical timer that can be manually wound up to different delay times. Alternatively, the timer means 100A could in another embodiment be electro-mechanical. The normal delay time may be the time it takes an average user to pull out the sheet 25 and attach it to the locking trim. This delay allows anyone to calmly pull out the sheet 25 and securely attach it to the locking trim. In an embodiment, the normal delay time is twenty seconds. Also, the timer means 100A may easily be adjusted to different delay times. After the delay time has elapsed the barrier cannot be further extracted until the locking means 100B is released. This ensures that the gate always gets properly locked so that the sheet 25 cannot be further pulled out.

Figure 2:
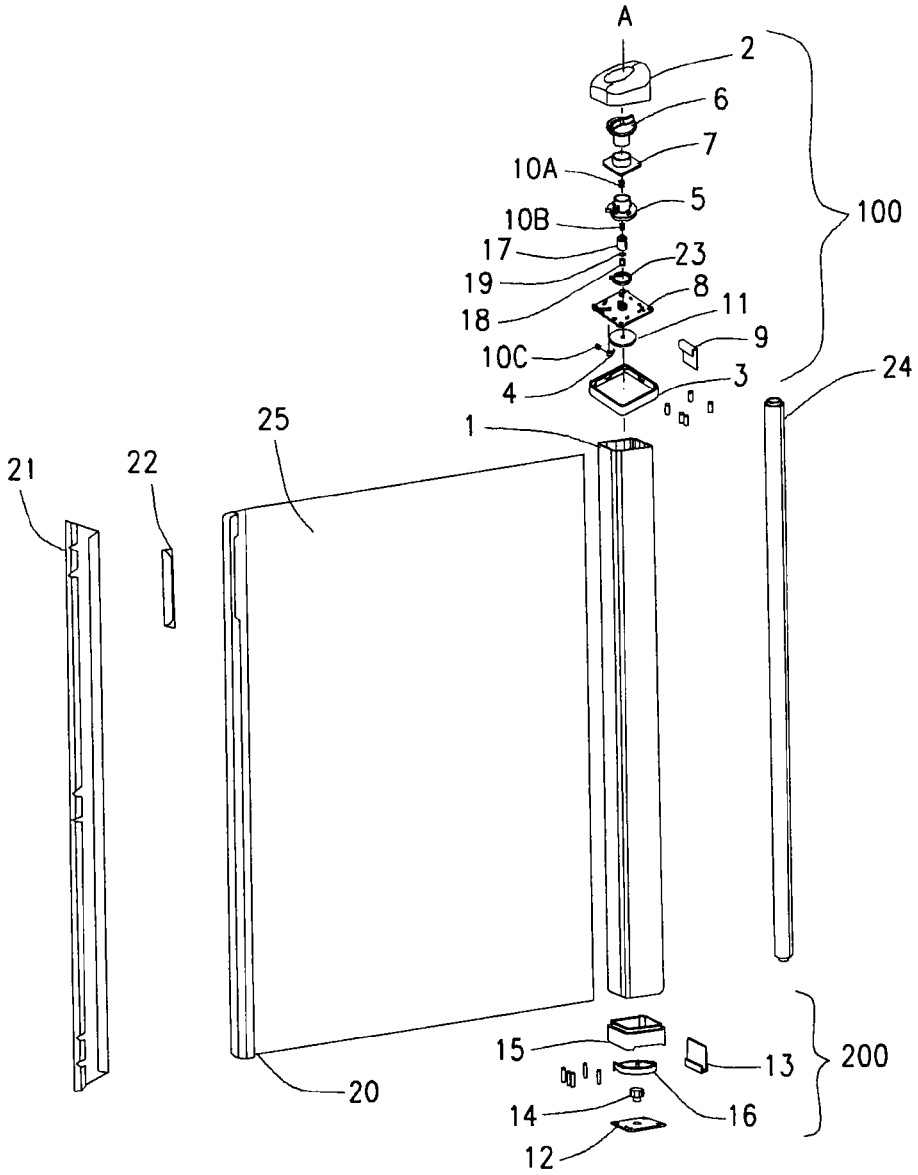
FIG. 2 is an exploded perspective view of the child safety gate of FIG. 1 according to one embodiment of the invention, shown with the barrier sheet in a partly pulled out position.
Figure 2A:
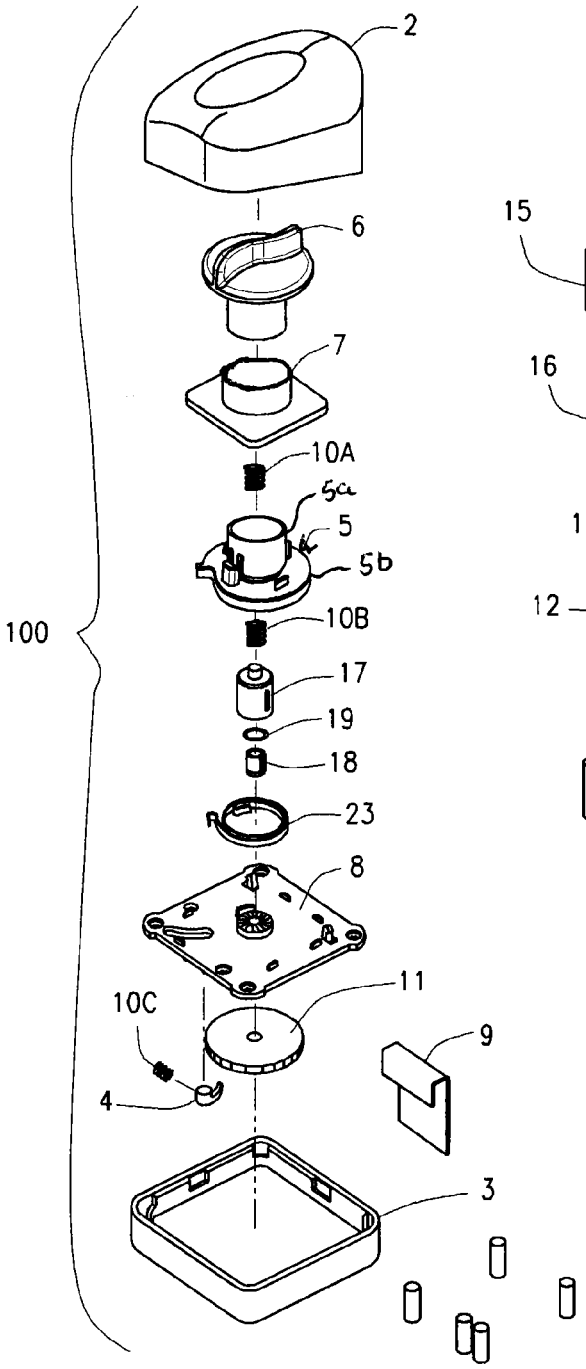
FIG. 2A is an exploded view of a locking device of the safety gate.
Figure 2B:
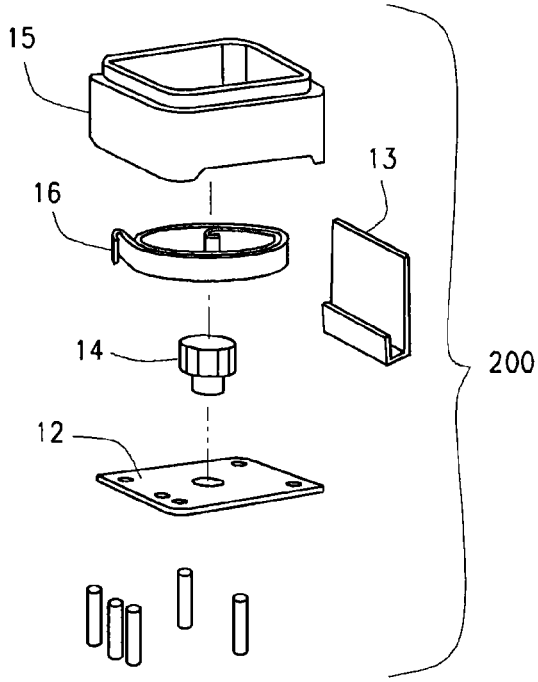
FIG. 2B is an exploded view of a rollback device of the safety gate.

With reference to FIG. 2, the locking means 100B and timer means 100A of the locking device 100 may be integrated into a single mechanical assembly (i.e., the locking device 100). The locking device 100 may comprise: a top casing 3, a lock actuator 4, a release wheel 5, a control knob 6, an upper middle lid 7, a lower middle lid 8, an upper wall fixing 9, first, second and third springs 10A, 10B, 10C, and a locking wheel 11.

The hollow release wheel 5 comprises a hollow cylinder 5*a* and a variable contour cam 5*b*. The release wheel 5 is engaged with the knob 6 so that they are kept from relative rotation around their common longitudinal axis A. Further, the release wheel 5 and the knob 6 are slidable relative to each other along their common longitudinal axis A for enabling the knob 6 to have an upper and a lower position. The first spring 10A pushes the release wheel 5 and the knob 6 apart for bringing the knob into its upper position. In the upper position a knob protrusion 6*a* on the knob prevents the knob 6 from being rotated relative to the upper middle lid 7. When the knob 6 is pushed down to its lower position, the knob protrusion 6*a* is released from the upper middle lid 7 and the knob may be rotated around its longitudinal axis A.

A lower middle lid 8 may be located under the release wheel 5 for supporting the release wheel 5.

Timer Means

A hollow delay socket 17 may be positioned in the hollow cylinder of the hollow release wheel 5 so that they are kept from relative rotation around their common longitudinal axis A. The second spring 10B is positioned between the hollow delay socket 17 and the hollow cylinder of the hollow release wheel 5 for pushing the socket 17 and the wheel 5 apart so that a delay peg 18 is pushed against the lid 8.

Figure 3:
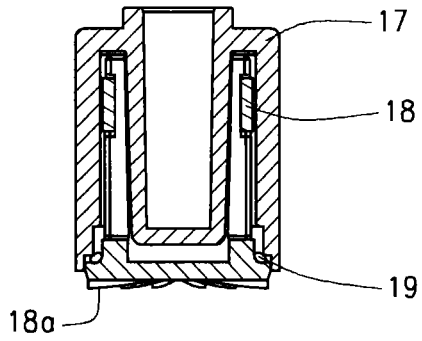
FIG. 3 is a cross-sectional view of a delay socket, a delay peg and a gasket according to an embodiment of the present invention.

According to an embodiment, with reference to FIG. 3, the delay peg 18 may be rotatably positioned with clearance fit in the hollow delay socket 17. High viscosity grease may be provided between the delay peg 18 and the hollow delay socket 17 to slow down rotation of the release wheel 5 caused by the momentum from a delay drive spring 23. An O-ring 19 may be provided between the delay peg 18 and the delay socket 17 in order to provide a seal between them and keep the high viscosity grease from leaking out.

In order to slow down rotation of the release wheel 5 in only one direction and not in the other, the delay peg 18 is restricted from rotation in only one direction and not in the other. This is achieved by providing angular teeth 18*a* on the end of the delay peg 18 which face the lower middle lid 8, and also providing matching angular teeth 8*a* on the lower middle lid 8. The teeth 18*a* and 8*a* provide grip between the lid 8 and the delay peg 18 (or mesh with each other) in one rotational direction but slip relative to, or over each other, during rotation in the other direction.

Figure 7:
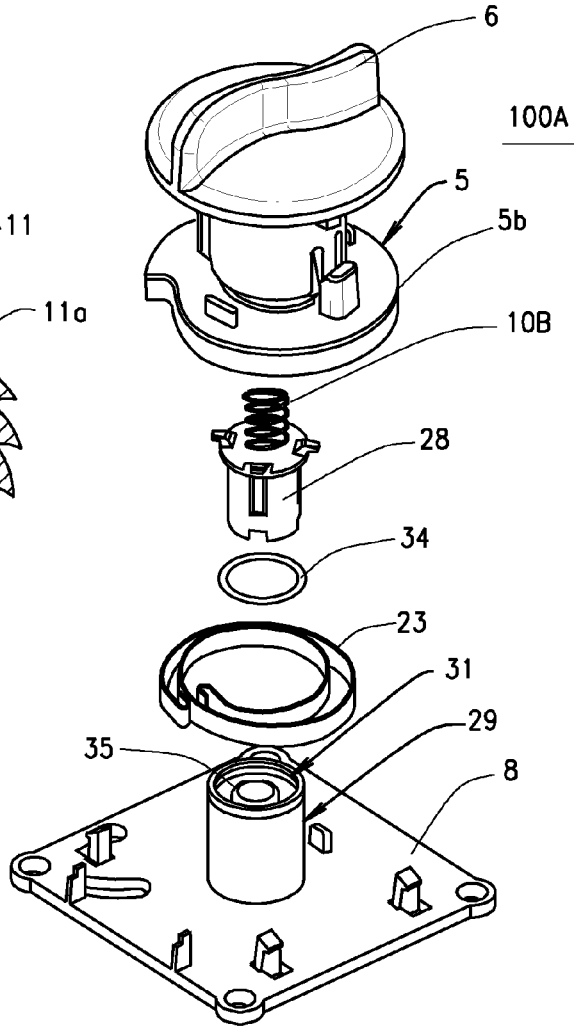
FIG. 7 is an exploded perspective view of some parts related to a locking device according to an alternative embodiment of the present invention.
Figure 8:
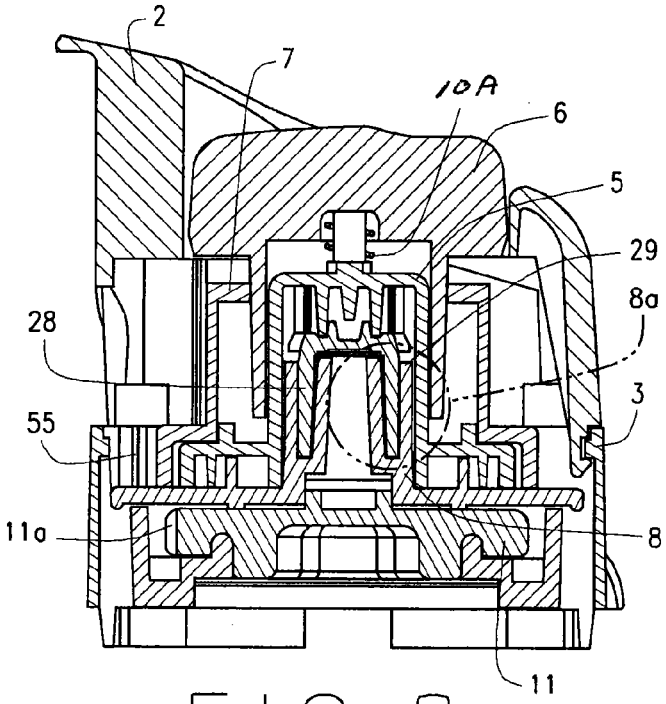
FIG. 8 is a cross-sectional view of a locking device according to FIG. 7, taken through a vertical plane at the diameter of the locking device.
Figure 8A:
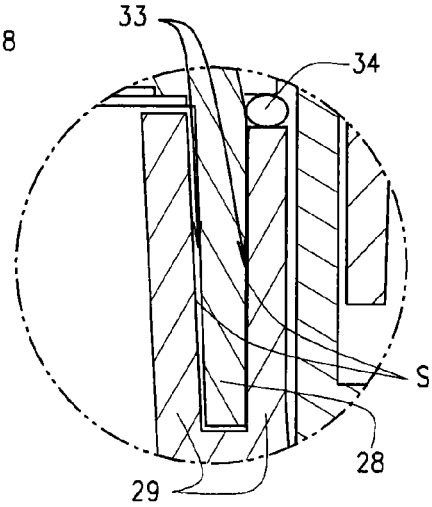
FIG. 8*a* shows an enlarged detail of FIG. 8.

According to another embodiment, with reference to FIG. 7, the timer means 100A comprises a delay peg 28, a delay socket 29, and delay substance S between the delay socket 29 and the delay peg 28 (see FIG. 8*a*).

The delay socket 29 has an upper opening 31 adapted to receive the delay peg 28. Also, as shown in FIG. 9, the delay socket 29 has a closed bottom 32.

The delay socket 29 has the shape of a hollow cylinder positioned on the upper side of the lid 8 and aligned with the rotational axis of the knob 6 and the release wheel 5. The delay socket 29 is integrated with the lid 8, thereby reducing the total number of parts of the locking device and lowering the risk of faulty assembly.

Figure 9:
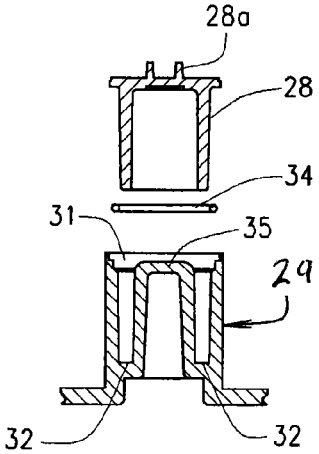
FIG. 9 is a cross-sectional view of some parts of a locking device according to FIG. 7, taken through a vertical plane at the diameter of the locking device parts.

As shown in FIGS. 8 and 9, the delay peg 28 is adapted to be rotatably positioned in the delay socket 29, thereby forming a pocket 33 between the socket 29 and the delay peg 28. Further, the delay peg 28 is provided with one or more protrusions and/or indentations for engagement with the knob and/or with the release wheel 5. The protrusions and/or indentations act to prevent relative rotation between the delay peg 28 and the knob 6 and/or the release wheel 5, so that the delay peg 28 co-rotates with the release wheel 5.

In order to achieve a controlled friction force acting on the delay peg 28, a high-viscous delay substance S, such as high-viscosity grease, is provided in the pocket 33. The delay substance S sticks to the surfaces of the delay socket 28 and the delay peg 28 and thereby counteracts any relative rotation between them. A gasket, such as a rubber O-ring 34, may be provided between the delay peg 28 and an upper portion of the delay socket 29 in order to seal the pocket 33 so that no delay substance S leaks out.

As shown in FIG. 9, a shaft 35 may be provided in the delay socket 29 for steering the delay peg 28 in the delay socket 29 so that the volume and shape of the pocket 33 remains substantially unchanged during movement of the delay peg 28, thereby ensuring smooth functionality of the delay substance S.

The closed bottom 32 of the fixed delay socket 29 assures that no delay substance S can leak out downwardly. Leakage of delay substance S would possibly lead to loss of friction acting on the delay peg 28, which in turn would make the timer lapse faster than intended. It should be understood that the delay socket 29 could as well be a separate part which is attached onto the lid 8, thereby preventing rotation of the delay socket 29 around its longitudinal axis in both directions. Also, the delay socket 29 could be a separate part which is not attached to the lid 8, but which is provided with teeth, as previously described, in order to prevent rotation of the delay socket 29 around its longitudinal axis in one direction, but not in the other.

Figure 10:
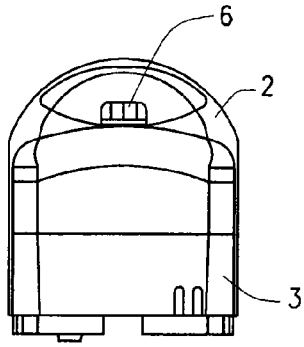
FIG. 10 is a front view of a locking device according to embodiments of the invention.

FIG. 10 shows an assembled locking device according to an embodiment of the invention. The locking device has a knob 6, a top cover 2, and a top casing 3.

Locking Means

Figure 4:
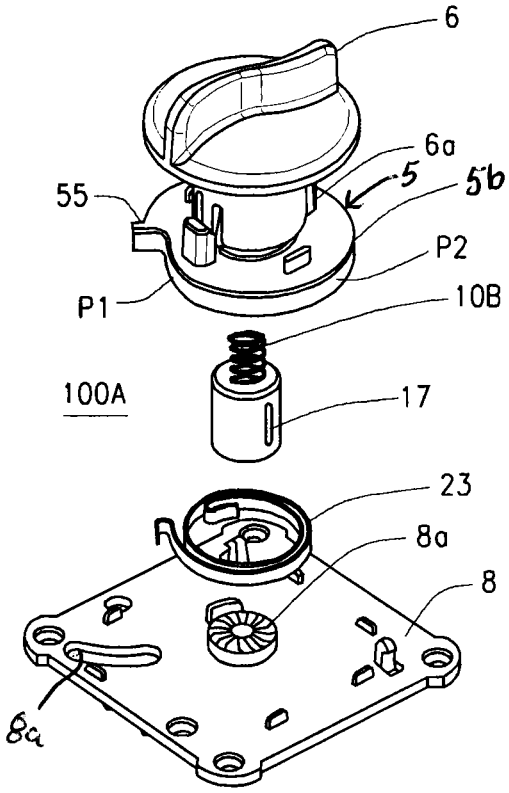
FIG. 4 is an exploded perspective view of one embodiment of some parts related to the locking device of FIG. 1.

With reference to FIG. 4, the delay drive spring 23 may be located inside the release wheel 5 for providing a momentum for rotating the release wheel 5 back to its original position after it has been rotated by turning the knob 6. The delay drive spring 23 is tightened when the knob 6 is turned. The knob 6 may be turned in order to set a certain delay time for delaying the locking of the locking means. The delay time depends on how much the knob is rotated. When the delay drive spring 23 is released the knob 6 automatically rotates back due to the momentum created by the delay drive spring 23.

Figure 5:
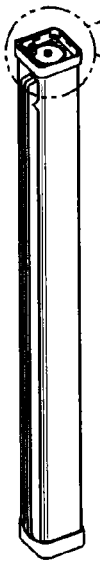
FIG. 5 is a perspective view of some parts related to the locking device of FIG. 1.
Figure 5A:
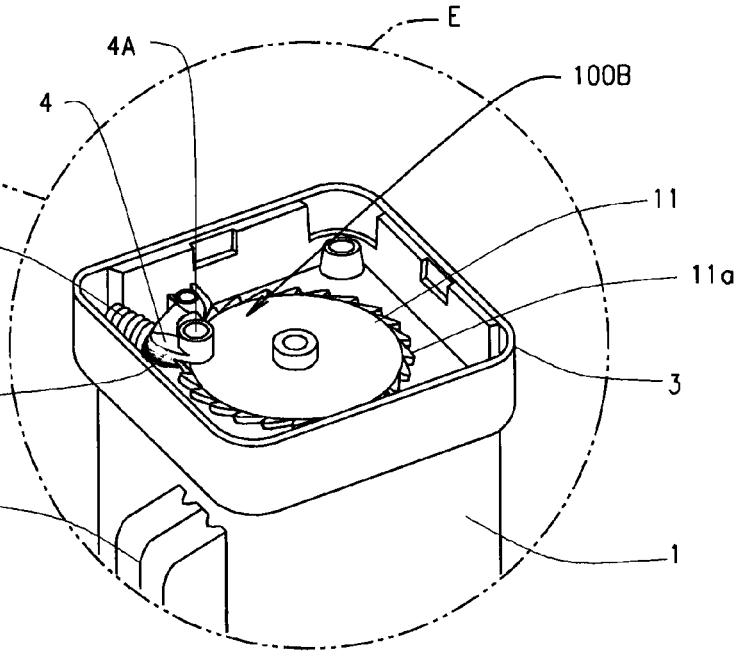
FIG. 5*a* shows an enlarged detail of FIG. 5.
Figure 6:
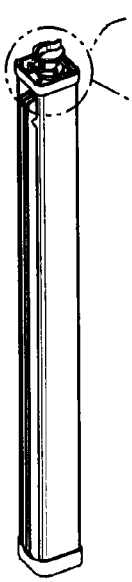
FIG. 6 is a perspective view of some parts related to the locking device according to the present invention.
Figure 6A:
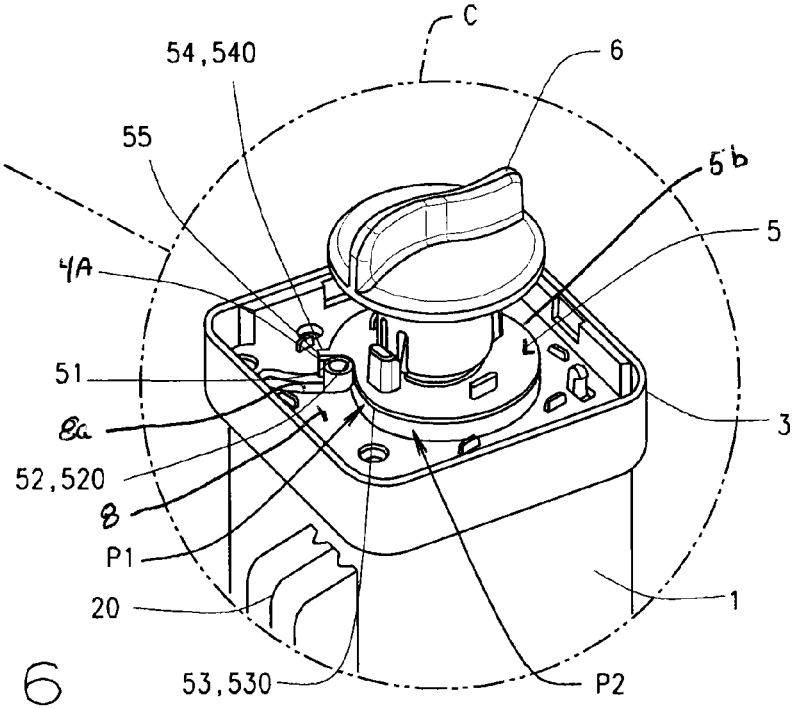
FIG. 6*a* shows an enlarged detail of FIG. 6.
Figure 6B:
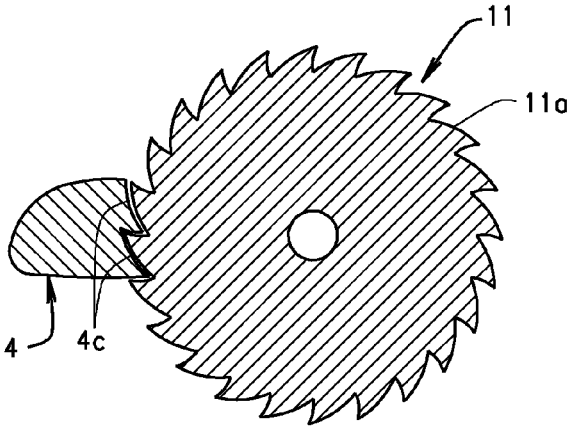
FIG. 6*b* is a schematical cross-sectional view showing the engagement of the lock actuator with the locking wheel.

With reference to FIGS. 5-6*b*, the locking wheel 11, which has a plurality of teeth 11*a*, is positioned under the lower middle lid 8, and preferably does not contact the lower middle lid 8. The lock actuator 4 has a handle 4A and a lock protrusion 4B. The lock protrusion 4B is provided with teeth 4*c* adapted to grip the teeth 11*a* of the locking wheel 11 for keeping the locking wheel 11 from rotating in a first direction when the locking device 100 is in a locked position. The first direction is the same direction that the locking wheel 11 rotates when the sheet 25 is pulled out. When the locking device 100 is in its locked position and the locking wheel 11 rotates in a direction opposite the first direction, the teeth 4*c* of the lock protrusion 4B slip over the teeth 11*a* of the locking wheel 11. When the teeth slip past each other, they may cause a disturbing clicking noise. If the locking device 100 is in its unlocked position, the lock actuator 4 is disengaged from the locking wheel 11 and the locking wheel 11 is free to rotate in both directions without any clicking noise. The third spring 10C is positioned between the top casing 3 and the lock actuator 4 for pushing the lock actuator 4 against the locking wheel 11. The variable contour cam 5*b* of the release wheel 5 is designed and positioned for controlling the maximum movement of the lock actuator 4 so that the spring-loaded lock actuator 4 does not always engage and lock the locking wheel 11. To this end, as seen in FIG. 6A, the handle 4A of the lock actuator 4 extends up through a slot 8*a* in the lid 8 to be adjacent the variable contour cam 5*b* of the release wheel 5. The variable contour cam provides a stop surface that the handle 4A of the spring-loaded lock actuator 4 is pushed against and slides against during rotation of the release wheel 5. Since the contour is variable, the handle and the rest of the lock actuator 4 move accordingly between the locked and the unlocked position. The locking wheel 11 is connected to the roll 24 and keeps the roll 24 from rotating when the lock actuator 4 locks the locking wheel 11.

With reference to FIG. 6, the variable contour cam 5*b* has a first and a second portion P1 and P2. The first portion P1 is defined between a first point 52 on the cam and a second point 53 on the cam. The radius increases gradually in the first portion P1 from a first radius 520 at the first point 52, to a second radius 530 at the second point 53. The first radius 520 is small enough to allow the handle 4A of the lock actuator 4 to come close enough to the locking wheel 11 for locking the locking wheel 11. The second radius 530 is large enough to move the lock actuator 4 far enough away from the locking wheel 11 to bring the locking device 100 into its unlocked position. The first stop surface 51 is provided for stopping a rotation of the release wheel 5 once the lock actuator 4 is positioned by the first point 52. The second portion P2 is defined between the second point 53 and a third point 54 at a third radius 540. The third radius 540 is preferably equal to the second radius 530 so that the handle 4A easily slides along the cam between these points 54, 53. A second stop surface 55 is provided at the end of the second portion P2 for limiting the maximum rotation of the release wheel 5 when the release wheel 5 is being rotated for bringing the locking device into its unlocked position and setting a delay time. When the release wheel 5 is rotated to unlock the locking device 100, the handle 4A gradually slides outwardly from the first radius 520 in the first portion P1 to the second radius 530 in the second portion P2, and onto the third radius 540 in the second portion P2, until the handle 4A finally hits the second protrusion 55. The second radius 530 is large enough to make sure that the locking device 100 will be in its unlocked position when the handle 4A passes the second point 53.

With reference to FIGS. 1 and 2, the rollback device 200 may comprise: a bottom lid 12, a lower wall fixing 13, a drive wheel 14, a bottom casing 15 and a drive spring 16. However, the rollback device 200 could also comprise some other drive means, such as a rubber band or an electric motor.

According to an embodiment, a method for engaging a safety gate is provided, wherein the method comprises:

Bringing a locking means 100B for a safety gate into its unlocked position,

Activating a timer means 100A,

Pulling out a flexible sheet 25, and

Attaching the flexible sheet 25 to a locking trim.

However, it is to be understood that even though numerous characteristics and advantages of the present invention have been set forth in the foregoing description, together with details of the structure and function of the invention, the invention is illustrative only, and changes may be made in detail, especially in matters of shape, size, and arrangement of parts within the scope of the invention to the full extent indicated by the broad general meaning of the terms in which the appended claims are expressed.

The invention claimed is:

1. A child safety gate comprising a flexible retractable barrier sheet mounted to a roll about which said barrier sheet is windable; said roll being rotatable about an axis of rotation; said barrier sheet being movable between an extended position and a retracted position, and a locking device; said locking device comprising (a) a locking mechanism comprising:

(i) a rotatable cam rotatable about an axis of rotation parallel to the axis of rotation of said roll, said cam having a side surface defining a stop surface and defining a generally spiral-shaped cam surface extending from an inner end of said stop surface to an outer end of said stop surface, said generally spiral-shaped cam surface defining a first radius at said inner end of said stop surface and a second radius larger than said first radius at the outer end of said stop surface;

(ii) a lock actuator comprising a generally axially extending body, a to portion of said body defining a cam follower which engages said cam surface and a lock member at a lower portion of said body, said lock member defining a toothed portion of said lock actuator; said lock actuator being movable in a plane generally perpendicular to the axis of rotation of said cam between at least a locked position and an unlocked position by movement of the cam, (iii) a toothed member; said toothed member being generally parallel to said cam and spaced from said cam along said axis of rotation of said cam; said toothed member being operatively connected to said roll to rotate about said axis of rotation of said roll; said toothed member having a toothed surface facing the toothed portion of said lock actuator; wherein when the lock actuator is in its locked position the toothed portion of said lock actuator engages the toothed surface of said toothed member to prevent further unwinding of the flexible retractable barrier sheet, and wherein when the lock actuator is in its unlocked position said toothed portion of said lock actuator is spaced from the toothed surface of said toothed member to allow at least unwinding of the flexible retractable barrier sheet, and (iv) a biasing member which biases said toothed portion of said actuator toward the teeth of said toothed member; and (b) a timer configured to, upon activation, let a delay time elapse and then move the locking mechanism from its unlocked position to its locked position.

2. The safety gate according to claim 1, wherein the timer comprises a mechanical delay.

3. The safety gate according to claim 2, wherein said delay comprises a delay peg, a delay socket, and delay substance between the delay socket and the delay peg.

4. The safety gate according to claim 3 wherein the delay socket has a closed bottom and an upper opening adapted to receive the delay peg.

5. The safety gate according to claim 3, wherein the delay substance is high-viscous grease.

6. The safety gate according to claim 1, wherein the locking mechanism and the timer are integrated into a mechanical assembly.

7. A method for closing the child safety gate of claim 1, comprising the steps of bringing said locking mechanism for the safety gate into its unlocked position, activating said timer, pulling out said flexible sheet, and attaching the flexible sheet to a locking trim.

8. The child safety gate of claim 1 further comprising a biasing member which acts on said actuator to urge said cam follower against said cam surface.

9. The child safety gate of claim 1 further comprising a spring element operatively connected to said cam to rotate said cam from a position in which said actuator is in said unlocked position to a position in which said actuator is in said locked position.

10. A locking device for a child safety gate comprising a flexible barrier sheet connected to a roll about which said flexible retractable barrier sheet is windable; said locking device comprising:

(a) a rotatable generally circular member having a circumferential surface defining outwardly facing teeth; said generally circular member rotating about an axis of rotation;

(b) a rotatable release wheel, said release wheel rotatable about an axis of rotation parallel to the axis of rotation of said generally circular member and comprising a cylinder and a cam extending from said cylinder, said cam having a side surface defining a stop surface and defining a generally spiral-shaped cam surface extending from an inner end of said stop surface to an outer end of said stop surface, said generally spiral-shaped cam surface defining a first radius at said inner end of said stop surface and a second radius larger than said first radius at the outer end of said stop surface;

(c) an actuator comprising a generally axially extending body, a top portion of said body defining a cam follower which engages said cam surface and a toothed portion having teeth which face the teeth of said generally circular member; said lock actuator being movable in a direction generally perpendicular to said axis of rotation of said release wheel between at least a locked position and an unlocked position by rotation of the cam; wherein when the actuator is in its locked position said teeth of said actuator operatively engage said teeth of said generally circular member to prevent further rotation of said generally circular member in at least one direction, and wherein when the actuator is in its unlocked position said teeth of said actuator do not operatively engage said teeth of said generally circular member to allow rotation of said generally circular member in said at least one direction, (d) a biasing member which biases said toothed portion of said actuator toward the teeth of said toothed member (e) an activating knob received on said release wheel cylinder; said activating knob and release wheel cylinder being axially slidable relative to each other; said knob being movable between a raised and a lowered position relative to said release wheel; said knob and release wheel being connected together such that when said knob is in one of its raised and lowered positions, said knob is rotationally fixed relative to said release wheel and when said knob is in the other of its raised and lowered positions, said knob can rotate relative to said release wheel; and (f) a timer received in said release wheel cylinder; said timer comprising a delay socket and a delay peg received in said delay socket; one of said delay socket and delay peg being operatively connected to said lower lid to prevent rotation of said one of said delay socket and delay peg in at least one direction, the other of said delay socket and delay peg being operatively connected to said release wheel.

11. The locking device of claim 10 including a spring element positioned to bias said knob to its raised position.

12. The locking device of claim 10 including a spring element positioned to bias said delay socket away from said release wheel and toward said lower lid.

13. The locking device of claim 10 including a delay substance between the delay socket and delay peg and a seal at an opening of said delay socket to prevent the delay substance from exiting said delay socket.

14. The locking device of claim 10 wherein said delay peg has angular teeth at an end thereof, and said lower lid has angular teeth on a surface thereof; said teeth of said delay peg and said lower lid providing a grip between the lower lid and the delay peg to prevent rotation in a first rotational direction but slip during rotation in a second direction to allow rotation in the second direction.

15. The locking device of claim 10 wherein said delay socket opens upwardly.

16. The locking device of claim 15 wherein the delay peg is configured to positively engage the knob and/or the release wheel to prevent relative rotation between the delay peg and the knob and/or release wheel, such that the delay peg co-rotates with the release wheel.

17. The locking device of claim 10 wherein the locking mechanism comprises a rotatable locking wheel defining a plurality of teeth and a lock actuator; said locking wheel being generally aligned with said release wheel and operatively connected to said roll; said lock actuator comprising a handle and a lock protrusion; said lock protrusion comprising teeth; said lock actuator being movable between a locking position in which the teeth of the lock protrusion engage the teeth of the locking wheel to prevent rotation of the locking wheel and an unlocked position in which the teeth of the lock protrusion do not engage the teeth of the locking wheel.

18. The locking device of claim 17 wherein said handle of said lock actuator extends axially, such that a portion of said handle is adjacent said camming surface of said release wheel cam; whereby, movement of said release wheel will move said lock actuator from said locking position to said unlocking position.

19. The locking device of claim 17 including a spring element positioned to bias said lock actuator into its said locking position.

20. The locking device of claim 10 further comprising a spring element operatively connected to said release wheel to rotate said release wheel, and thus said cam, from a position in which said actuator is in said unlocked position to a position in which said actuator is in said locked position.

21. A child safety gate comprising a flexible retractable barrier sheet windable about a roll to be selectively unwound from said roll, said roll being rotatable about an axis of rotation and a locking device; said locking device comprising:

(a) a locking mechanism comprising:

(i) a rotatable generally circular member having outwardly facing teeth; said generally circular surface being operatively connected to said roll to rotate with said roll about said axis of rotation;

(ii) a cam spaced from said generally circular member along said axis of rotation and being generally coaxially aligned with said generally circular member and with said roll such that said cam is rotatable about said axis of rotation, said cam having a side surface defining a stop surface and defining a generally spiral-shaped cam surface extending from an inner end of said stop surface to an outer end of said stop surface, said generally spiral-shaped cam surface defining a first radius at said inner end of said stop surface and a second radius larger than said first radius at the outer end of said stop surface;

(iii) an actuator having a generally axially extending body, a top portion of said body defining a cam follower which engages said cam surface and a toothed portion having teeth which face the teeth of said generally circular member; said actuator being biased into engagement with said cam surface; said actuator being movable in a direction generally perpendicular to said axis of rotation between at least a locked position and an unlocked position by rotational movement of the cam; wherein when the actuator is in its locked position said teeth of said actuator operatively engage said teeth of said generally circular surface to prevent further unwinding of the flexible retractable barrier sheet from the roll, and wherein when the actuator is in its unlocked position said teeth of said actuator do not operatively engage said teeth of said generally circular member to allow at least unwinding of the flexible retractable barrier sheet, and (iv) a biasing member which biases said toothed portion of said actuator toward the teeth of said toothed member; and (b) a timer configured to upon activation let a delay time elapse and then bring the locking mechanism into its locked position.

* * * * *